US006158738A

United States Patent [19]

Van Buskirk

[11] Patent Number: 6,158,738

[45] Date of Patent: Dec. 12, 2000

[54] GAMING DICE

[76] Inventor: Robert A. Van Buskirk, 6407H E. Buttercup Dr., USAF Academy, Colo. 80840-1325

[21] Appl. No.: 09/055,335

[22] Filed: Apr. 6, 1998

[51] Int. Cl.[7] ..... A63F 5/04

[52] U.S. Cl. ..... 273/147; 273/146; 273/143 A; D21/372; D21/373

[58] Field of Search ..... 273/147, 146, 273/143 A; D21/372, 373

[56] References Cited

U.S. PATENT DOCUMENTS

| | | | |
|---|---|---|---|
| 1,520,010 | 12/1924 | Clark | 273/247 |
| 1,520,011 | 12/1924 | Clark | 273/147 |
| 2,976,045 | 3/1961 | Mason | 273/147 |
| 4,566,697 | 1/1986 | Vickers | 273/146 |
| 4,807,883 | 2/1989 | Silverman | 273/146 |
| 4,900,034 | 2/1990 | Bereuter | 273/274 |
| 5,031,915 | 7/1991 | Sanditen | 273/146 |

FOREIGN PATENT DOCUMENTS

| | | | |
|---|---|---|---|
| 2447212 | 9/1980 | France | 273/146 |

*Primary Examiner*—Benjamin H. Layno
*Attorney, Agent, or Firm*—G. F. Gallinger

[57] ABSTRACT

A die which generates higher values of random numbers. The die for generating a randomly occurring number between 1 and X comprises: a central body which has a lateral cross section which is an x sided polygon having sides of equal length when cut perpendicularly anywhere along a longitudinal axis. A number ranging between 1 and x is marked on an upper portion of the die when the die is resting on a lateral side, said number designating the side on which the die is resting.

5 Claims, 1 Drawing Sheet

GAMING DICE

FIELD OF INVENTION

This invention relates to dice used to play board games. More particularly this invention relates to a design for a die which can be used to generate random numbers between 1 and up to as high as 21.

BACKGROUND OF THE INVENTION

From ancient times men have played games. The traditional cubic die can be used to generate random numbers between 1 and 6. Higher random numbers than 6 cannot be generated. When two die are rolled concurrently numbers between 2 and 12 can be generated—but they are not random. There is a greater probability of rolling a 6 than a 2. Nonetheless, greater variability in outcomes is usually preferred to random outcomes in most games.

In many board games higher values of random numbers are desired. Greater variation, and greater interest can be generated when outcomes are more variable. Equal probability of achieving each outcome is also preferred. What is needed is to simple die which can randomly generate a greater variation of outcomes.

OBJECTS AND STATEMENT OF INVENTION

It is an object of this invention to disclose a die which can generate random numbers between 1 and 21. A die which generates a greater variation of outcomes, each outcome having an equal probability of occurring.

One aspect of this invention provides for a die for generating a randomly occurring number between 1 and X comprising: a central body which has a lateral cross section which is an x sided polygon having sides of equal length when cut perpendicularly anywhere along a longitudinal axis. A number ranging between 1 and x is marked on an upper portion of the die when the die is resting on a lateral side, said number designating the side on which the die is resting.

Another aspect of this invention provides for as above wherein the lateral cross section is uniform in size anywhere along the longitudinal axis.

Various other objects, advantages and features of novelty which characterize this invention are pointed out with particularity in the claims which form part of this disclosure. For a better understanding of the invention, its operating advantages, and the specific objects attained by its users, reference should be made to the accompanying drawings and description, in which preferred embodiments of the invention are illustrated.

FIGURES OF THE INVENTION

The invention will be better understood and objects other than those set forth will become apparent to those skilled in the art when consideration is given to the following detailed description thereof. Such description makes reference to the annexed drawings wherein.

Figure 1:
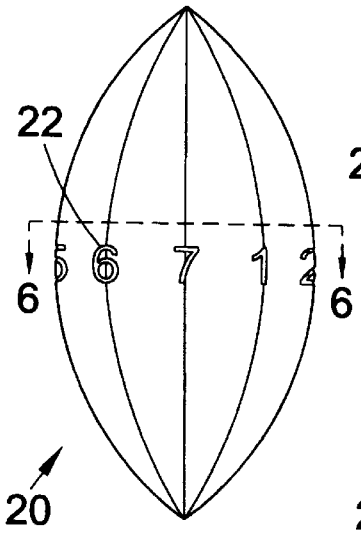
FIG. 1 is a perspective view of a torpedo shaped die having a cross section which is a polygon having sides of equal length.

The following is a discussion and description of the preferred specific embodiments of this invention, such being made with reference to the drawings, wherein the same reference numerals are used to indicate the same or similar parts and/or structure. It should be noted that such discussion and description is not meant to unduly limit the scope of the invention.

DESCRIPTION OF THE INVENTION

Turning now to the drawings and more particularly to FIG. 1 we have a perspective view of a torpedo shaped die 20 for generating a randomly occurring number between 1 and X. The die 20 comprises: a central body 22 which has a lateral cross section which is an x sided polygon 24 having sides of equal length when cut perpendicularly anywhere along a longitudinal axis. FIG. 6 is a cross sectional view of any of the dice 20 shown in FIGS. 1–5 as cut along line 6—6 therein. A number 22 ranging between 1 and x is marked on an upper portion of the die 20 when the die 20 is resting on a lateral side, said number 22 designating the side on which the die 20 is resting.

Figure 2:
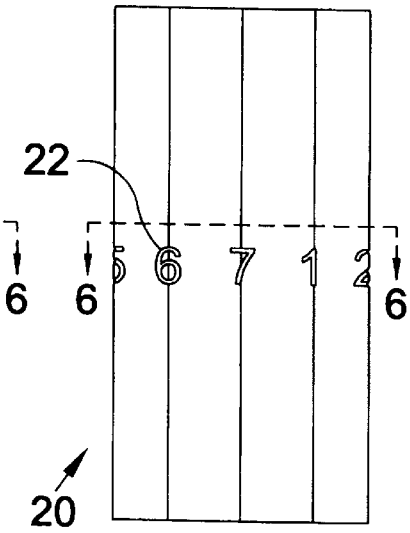
FIG. 2 is a perspective view of an alternate embodiment of a die. This die also has a cross section which is a polygon having sides of equal length.

FIG. 2 is of perspective view of an alternate embodiment of a die 20. This die 20 also has a cross section which is a polygon 22 having sides of equal length. The die 20 has a lateral cross section which is uniform in size anywhere along the longitudinal axis.

Figure 3:
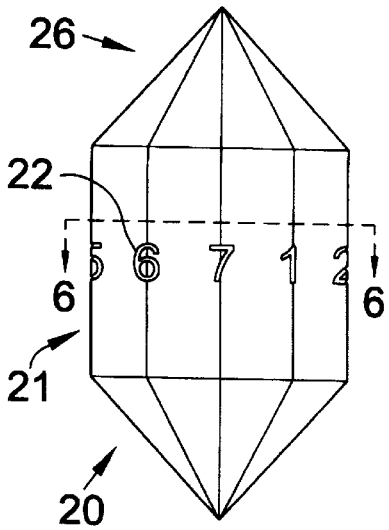
FIG. 3 is a perspective view of a die which has a central portion similar to the die shown in FIG. 2 but which additionally comprises an end portion.

FIG. 3 is a perspective view of a die 20 which has a central portion 21 similar to the die 20 shown in FIG. 2 but which additionally comprises an end portion 26. The end portion 26 has a lateral cross section which is an x sided polygon 24 having sides of equal length when cut perpendicularly anywhere along a longitudinal axis, said end portion 26 having a size equal to the central portion 21 on an end where attached thereto, and sloping to a point on an opposite unattached end.

Figure 4:
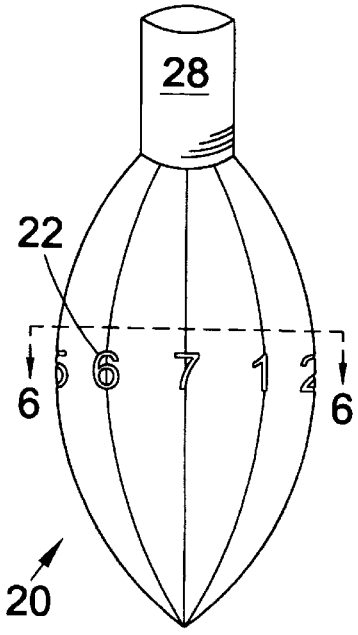
FIG. 4 is a die similar to that shown in FIG. 1 but which additionally has a cylindrical end portion for spinning therewith.

FIG. 4 is a die 20 similar to that shown in FIG. 1 but which additionally has a cylindrical end portion 28 for spinning the die 20 therewith. More particularly one end portion thereof is truncated and a generally cylindrical end portion 28 is attached thereto, generally having a diameter equal to the largest diameter of the portion truncated therefrom.

Figure 5:
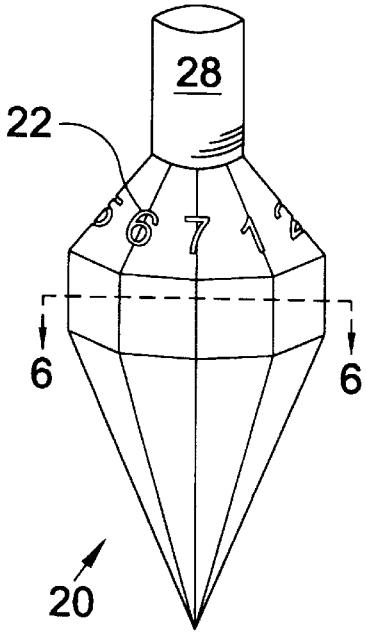
FIG. 5 is a die similar to that shown in FIG. 2 but additionally having a cylindrical end portion for spinning therewith and further comprises an opposite elongated end portion.
Figure 6:
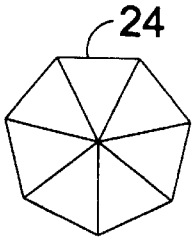
FIG. 6 is a cross sectional view of any of the dice shown in FIGS. 1–5 as cut along line 6—6 therein.

FIG. 5 is a die similar to that shown in FIG. 2 but additionally having a cylindrical end portion 28 for spinning the die therewith. The die 20 further comprises an opposite elongated end portion.

While the invention has been described with preferred specific embodiments thereof, it will be understood that this description is intended to illustrate and not to limit the scope of the invention. The optimal dimensional relationships for all parts of the invention are to include all variations in size, materials, shape, form, function, assembly, and operation, which are deemed readily apparent and obvious to one skilled in the art. All equivalent relationships to those illustrated in the drawings, and described in the specification, are intended to be encompassed in this invention. What is desired to be protected is defined by the following claims.

I claim:

1. A die for generating a randomly occurring number between 1 and X comprising:

a central body which has a lateral cross section which is an x sided polygon having at least 5 sides of equal length when cut perpendicularly anywhere along a longitudinal axis;

said die being generally torpedo shaped when viewed from a lateral side, each lateral tapering to opposite end portions and each lateral side arcing between the central body and the end portions wherein each side is arcuate so that the die will rock longitudinally after it comes to rest on an arcuate side.

2. A die as in claim 1 wherein x is an odd number and a number ranging between 1 and x is centered laterally on an upper portion of the die when the die is resting on a lateral side, said number designating the side on which the die is resting.

3. A die as in claim 1 wherein one end portion thereof is truncated;

said die further comprising a generally cylindrical substituted end portion attached thereto, generally having a diameter equal to the largest diameter of the portion truncated therefrom.

4. A die as in claim 1 where x is a prime number between 5 and 21 inclusive.

5. A die as in claim 1 wherein the die is molded in plastic and wherein the designating numbers are embedded in the plastic and colored a different color than the plastic.

* * * * *